US010424234B2

(12) United States Patent
Nicholson

(10) Patent No.: US 10,424,234 B2
(45) Date of Patent: Sep. 24, 2019

(54) DE-SATURATED COLOUR INJECTED SEQUENCES IN A COLOUR SEQUENTIAL IMAGE SYSTEM

(71) Applicant: CHRISTIE DIGITAL SYSTEMS USA, INC., Cypress, CA (US)

(72) Inventor: Stuart Nicholson, Waterloo (CA)

(73) Assignee: CHRISTIE DIGITAL SYSTEMS USA, INC., Cypress, CA (US)

( * ) Notice: Subject to any disclaimer, the term of this patent is extended or adjusted under 35 U.S.C. 154(b) by 342 days.

(21) Appl. No.: 14/508,395

(22) Filed: Oct. 7, 2014

(65) Prior Publication Data

US 2016/0098950 A1 Apr. 7, 2016

(51) Int. Cl.
*G09G 3/20* (2006.01)
*G09G 5/02* (2006.01)

(52) U.S. Cl.
CPC ..... *G09G 3/2003* (2013.01); *G09G 5/02* (2013.01); *G09G 2310/0235* (2013.01); *G09G 2320/0666* (2013.01)

(58) Field of Classification Search
CPC ..... G09G 5/02; G09G 2300/0421; G09G 2300/0426; G09G 2300/043; G09G 2310/0264; G09G 2310/027; G09G 2310/0272; G09G 2310/0275; G09G 2310/0278; G09G 2320/00; G09G 2320/02; G09G 2320/0204; G09G 2320/0228; G09G 2320/0233; G09G 3/20; G09G 3/2051;
(Continued)

(56) References Cited

U.S. PATENT DOCUMENTS 6,972,777 B2 * 12/2005 Shigeta ..... H04N 9/3123 345/690
8,358,384 B2 1/2013 Duffield
9,262,975 B2 * 2/2016 Iisaka ..... G09G 3/3426
(Continued)

FOREIGN PATENT DOCUMENTS

CN 101414449 A 4/2009
TW 201333909 A 8/2013

OTHER PUBLICATIONS

Partial European Search Report dated Mar. 23, 2016 for European Patent Application No. 15187313.0.
(Continued)

*Primary Examiner* — Grant Sitta
(74) *Attorney, Agent, or Firm* — Perry + Currier, Inc.

(57) ABSTRACT

De-saturated color injected sequences in a color sequential image system are provided. The system comprises: at least one spatial light modulator; a light system configured to produce a series of colors illuminating the modulator, the series comprising: saturated colors; and, de-saturated colors which respectively replace one or more of the saturated colors on either side of a center of the series of colors; and, an image processor configured to control the modulator to inject one or more of the de-saturated colors both prior to and following an active sequence of the saturated colors in at least a portion of pixels within a video frame, respective locations of the de-saturated colors selected to minimize respective times between at least one first de-saturated color prior to a first saturated color in the active sequence and between at least one second de-saturated color following a last saturated color in the active sequence.

16 Claims, 9 Drawing Sheets

(58) Field of Classification Search
CPC ..... G09G 3/2003; G09G 3/2055; G09G 2310/0235; G09G 2320/0666
USPC ..... 345/76, 204, 55, 598
See application file for complete search history.

(56) References Cited

U.S. PATENT DOCUMENTS

| | | | | |
|---|---|---|---|---|
| 2002/0109821 | A1* | 8/2002 | Huibers | G02B 26/008 353/84 |
| 2002/0122160 | A1* | 9/2002 | Kunzman | H04N 9/3114 353/31 |
| 2007/0064008 | A1* | 3/2007 | Childers | G09G 3/2022 345/589 |
| 2007/0076019 | A1* | 4/2007 | Randall | G09G 3/2025 345/691 |
| 2009/0102864 | A1* | 4/2009 | Fan-Chiang | G09G 3/3413 345/690 |
| 2010/0225238 | A1* | 9/2010 | Medin | G09G 3/3413 315/210 |
| 2010/0265281 | A1 | 10/2010 | Furukawa et al. | |
| 2011/0206126 | A1* | 8/2011 | Kim | G09G 3/20 375/240.16 |
| 2013/0201226 | A1 | 8/2013 | Wu | |

OTHER PUBLICATIONS

European Search Report dated Jul. 22, 2016 for European Patent Application No. 15187313.0.
SIPO, First Office Action (with English translation), Jun. 21, 2018, re Chinese Patent Application No. 201510647079.1.

* cited by examiner

DE-SATURATED COLOUR INJECTED SEQUENCES IN A COLOUR SEQUENTIAL IMAGE SYSTEM

FIELD

The specification relates generally to display systems, and specifically to de-saturated colour injected sequences in a colour sequential image system.

BACKGROUND

Colour sequential displays are often used when size, weight, cost and alignment precision outweigh brightness, bit depth and speed (frame rate) as performance criteria. These displays use a rapid sequence of monochrome images and rely on the time-integration properties of the human eye to yield a full-colour image for each frame of the video image. Typically the image sequence consists of one or more repetitions of three primary colours (red, green, blue) but may include additional colours for expanded gamut or increased brightness. Unfortunately, if the viewer's eye is moving across the display (for example, when tracking an object that is moving in the image) the monochrome images can become spatially separated on their retina, resulting in motion-blur and colour fringe artifacts. Colour fringe artifacts are false (unintended) colours that can appear at the interfaces between objects of significantly different colours in the image, in particular, at the interface between less saturated colours and dark areas.

SUMMARY

In general, this disclosure is directed to a system which can reduce colour fringe artifacts by injecting de-saturated (for example, white) monochrome colour images into a series of colours before and after an active sequence of saturated color monochrome images used to form a video frame. This approach is replicated at a pixel level as the duration of time during which a pixel is lit in the colour sequence may vary with pixel colour and intensity. Such injection of de-saturated monochrome colour images into the colour sequence before and after the saturated monochrome images used to form the frame can result in one or more of: reduced fringe artifacts; reduced white brightness loss, if any; and reduced saturated colour brightness loss. Artifacts can be most reduced when the duration of the injected images is: similar to the duration of the adjacent active sequence image; and temporally close to the adjacent active sequence image Thus techniques described herein can be applied to rapidly switching colour sequences, for example, where solid-state illuminators (LED or laser-phosphor) are used.

In this specification, elements may be described as "configured to" perform one or more functions or "configured for" such functions. In general, an element that is configured to perform or configured for performing a function is enabled to perform the function, or is suitable for performing the function, or is adapted to perform the function, or is operable to perform the function, or is otherwise capable of performing the function.

It is understood that for the purpose of this specification, language of "at least one of X, Y, and Z" and "one or more of X, Y and Z" can be construed as X only, Y only, Z only, or any combination of two or more items X, Y, and Z (e.g., XYZ, XY, YZ, ZZ, and the like). Similar logic can be applied for two or more items in any occurrence of "at least one . . . " and "one or more . . . " language.

An aspect of the specification provides a system comprising: at least one spatial light modulator; a light illumination system configured to produce a series of colours illuminating the at least one spatial light modulator, the series comprising: saturated colours; and, de-saturated colours which respectively replace one or more of the saturated colours on either side of a centre of the series of colours; and, an image processor configured to control the at least one spatial light modulator to inject one or more of the de-saturated colours both prior to and following an active sequence of the saturated colours in at least a portion of pixels within a video frame, respective locations of the de-saturated colours selected to minimize respective times between at least one first de-saturated colour prior to a first saturated colour in the active sequence and between at least one second de-saturated colour following a last saturated colour in the active sequence.

The image processor can be further configured to control the at least one spatial light modulator to inject one or more of the de-saturated colours between the first saturated colour and the last saturated colour in the active sequence in at least a portion of the pixels within the video frame.

The image processor can be further configured to inject one or more of the de-saturated colours at a given pixel when a brightness level of the given pixel is greater than twice a respective brightness level of the de-saturated colours.

The system can further comprise a memory storing a code table that relates one or more of pixel parameters, pixel colour and pixel intensity to pixel values, the pixel values defining at least the active sequence, and the image processor can be further configured to control the at least one spatial light modulator by processing the code table and image data representative of images to be formed by the at least one spatial light modulator.

The active sequence can comprise black values prior to the first saturated colour and after the last saturated colour, other than the de-saturated colours, the first saturated colour comprising a first non-black colour in the active sequence, and the last saturated colour comprising a last non-black colour in the active sequence.

Positions of the de-saturated colours in the series of colours can be selected based on a shape of the active sequence.

Positions of the de-saturated colours in the series of colours can be one of symmetric and not-symmetric with respect to one or more of the series of colours and the active sequence.

Positions of the de-saturated colours can be at least at both a beginning and an end of the series of colours.

Another aspect of the specification provides a method comprising: in a system comprising: at least one spatial light modulator; a light illumination system configured to produce a series of colours illuminating the at least one spatial light modulator, the series comprising: saturated colours; and, de-saturated colours which respectively replace one or more of the saturated colours on either side of a centre of the series of colours; and, an image processor: controlling, at the image processor, the at least one spatial light modulator to inject one or more of the de-saturated colours both prior to and following an active sequence of the saturated colours in at least a portion of pixels within a video frame, respective locations of the de-saturated colours selected to minimize respective times between at least one first de-saturated colour prior to a first saturated colour in the active sequence and between at least one second de-saturated colour following a last saturated colour in the active sequence.

The method can further comprise controlling the at least one spatial light modulator to inject one or more of the de-saturated colours between the first saturated colour and the last saturated colour in the active sequence in at least a portion of the pixels within the video frame.

The method can further comprise injecting one or more of the de-saturated colours at a given pixel when a brightness level of the given pixel is greater than twice a respective brightness level of the de-saturated colours.

The method can further comprise controlling the at least one spatial light modulator by processing a code table and image data representative of images to be formed by the at least one spatial light modulator, the code table stored at a memory, the code table relating one or more of pixel parameters, pixel colour and pixel intensity to pixel values, the pixel values defining at least the active sequence.

The active sequence can comprise black values prior to the first saturated colour and after the last saturated colour, other than the de-saturated colours, the first saturated colour comprising a first non-black colour in the active sequence, and the last saturated colour comprising a last non-black colour in the active sequence.

Positions of the de-saturated colours in the series of colours can be selected based on a shape of the active sequence.

Positions of the de-saturated colours in the series of colours can be one of symmetric and not-symmetric with respect to one or more of the series of colours and the active sequence.

Positions of the de-saturated colours can be at least at both a beginning and an end of the series of colours.

BRIEF DESCRIPTIONS OF THE DRAWINGS

For a better understanding of the various implementations described herein and to show more clearly how they may be carried into effect, reference will now be made, by way of example only, to the accompanying drawings in which.

Figure 7:
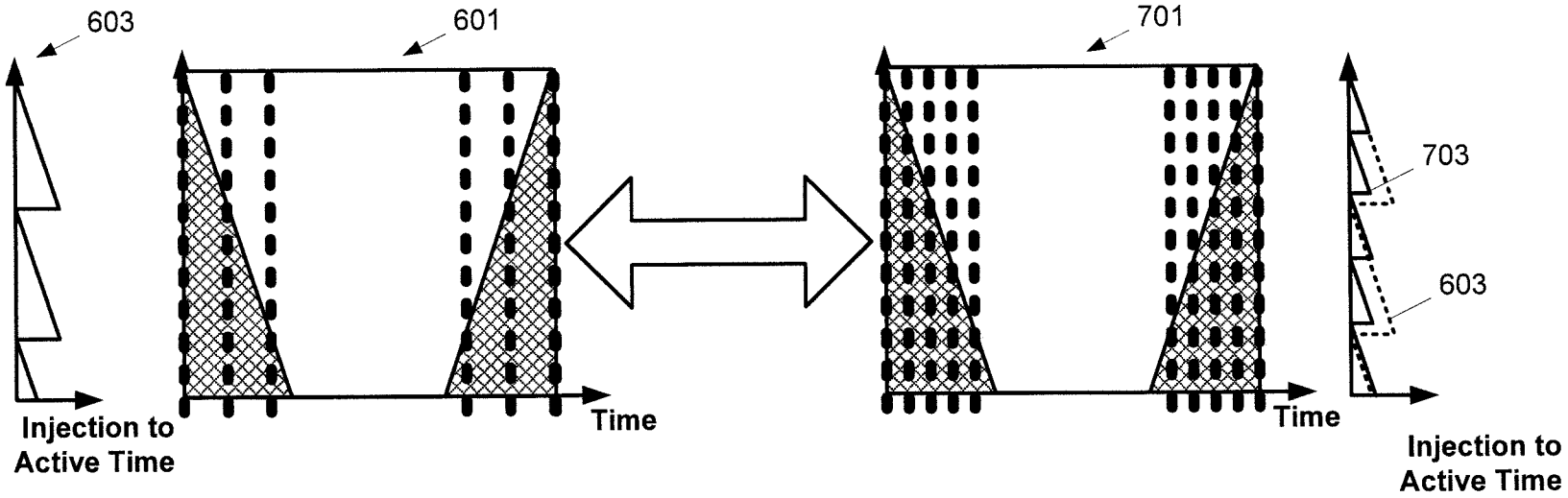

FIG. 7 compares similar graphs of first and last active saturated colours in active sequences with respect to pixel intensity, with one graph having six injected de-saturated colours and a second graph having ten injected de-saturated colours, according to non-limiting implementations.

Figure 8:
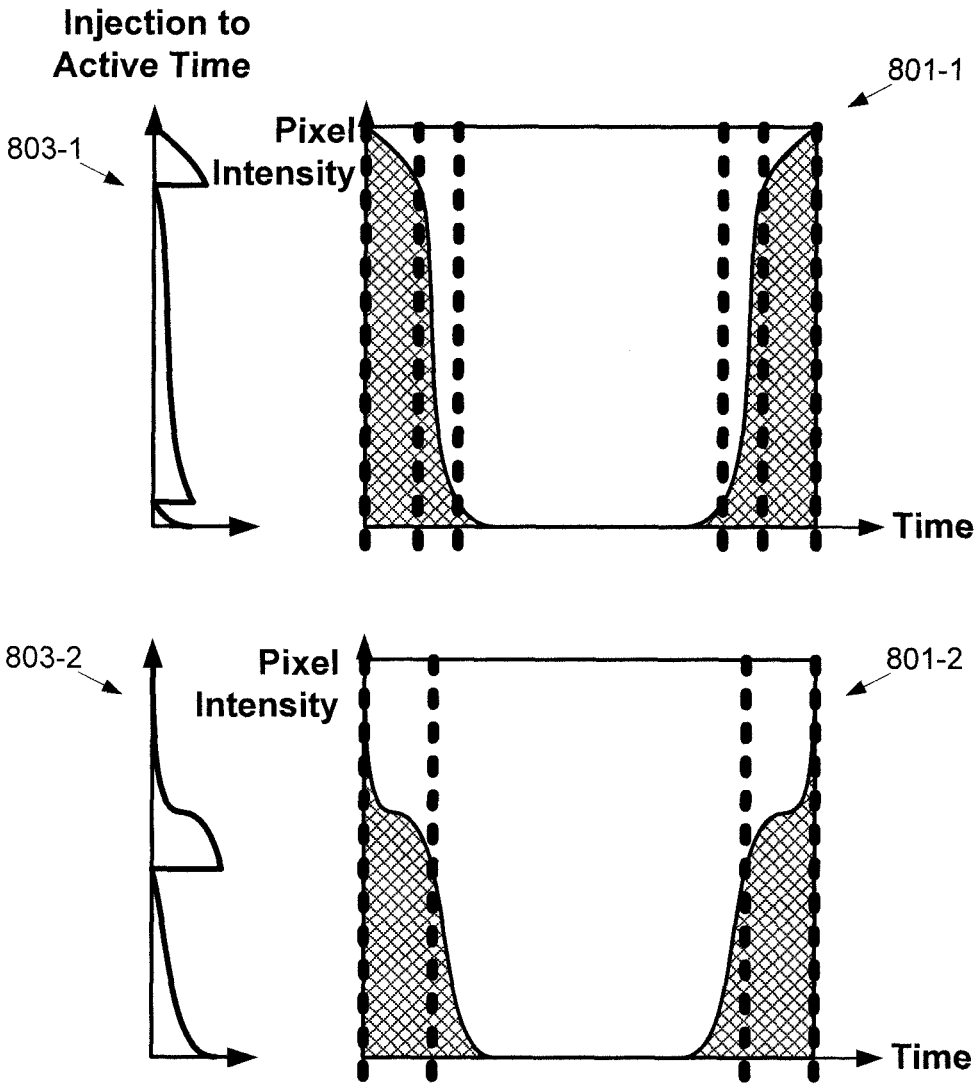

FIG. 8 depicts example graphs of first and last active saturated colours in differently shaped active sequences with respect to pixel intensity, according to non-limiting implementations.

Figure 9:
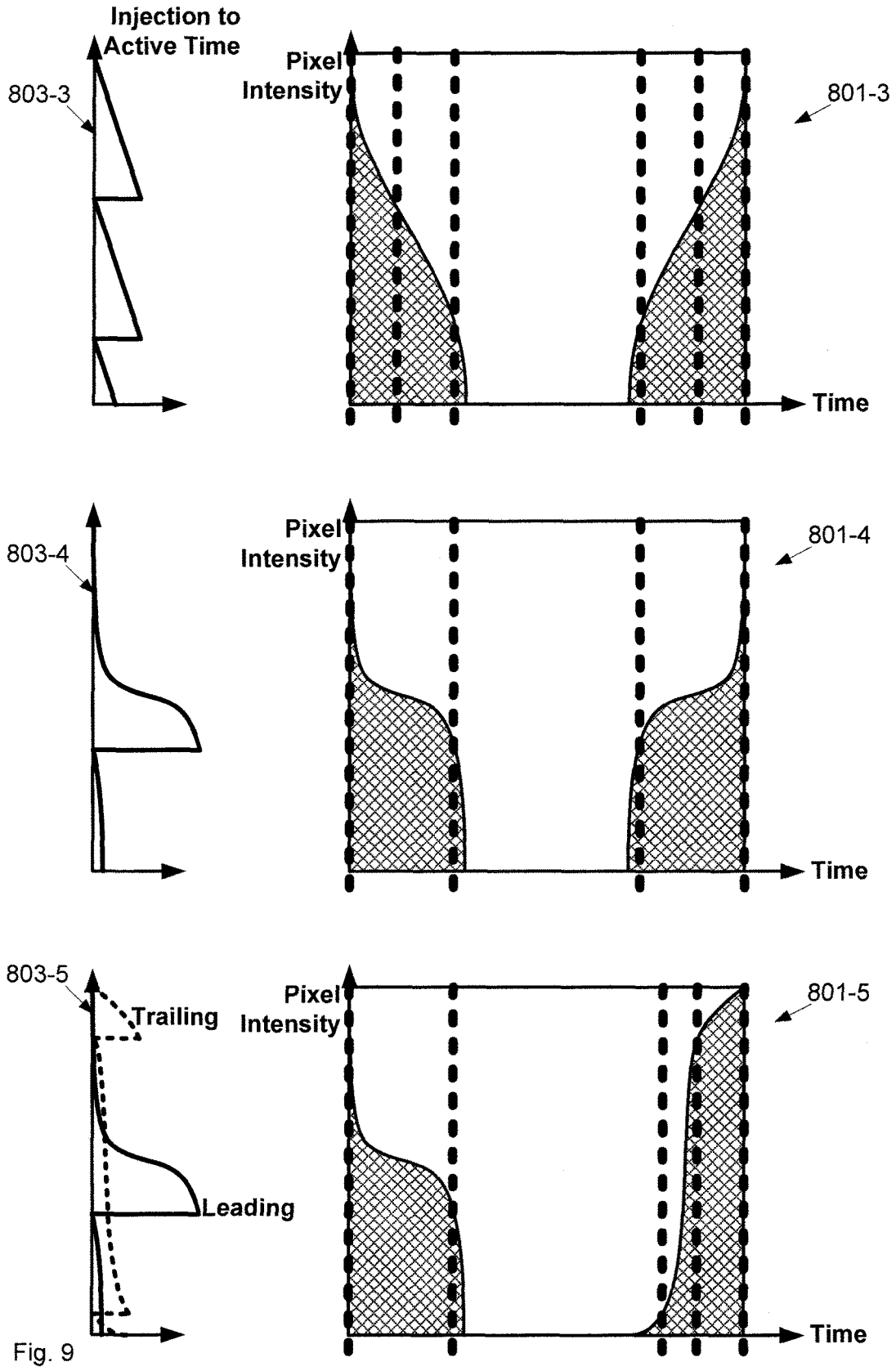

FIG. 9 depicts further example graphs of first and last active saturated colours in differently shaped active sequences with respect to pixel intensity, according to non-limiting implementations.

DETAILED DESCRIPTION

Figure 1:
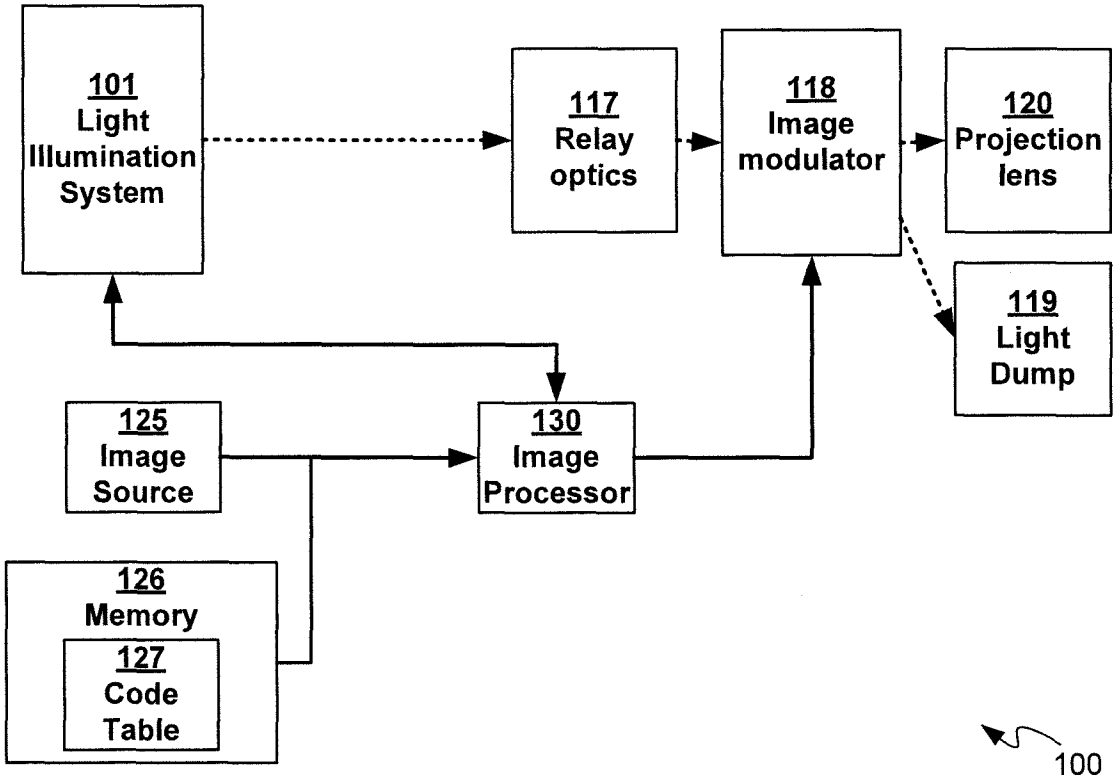
FIG. 1 depicts an imaging system in which de-saturated colours are injected into saturated colour sequences, according to non-limiting implementations.

FIG. 1 depicts an imaging system 100 with de-saturated colour injected sequences. System 100 comprises: a light illumination system 101; relay optics 117 (interchangeably referred to hereafter as optics 117); at least one spatial light modulator 118 (interchangeably referred to hereafter as modulator 118); a light modulator light dump 119 (interchangeably referred to hereafter as light dump 119); a projection lens 120; an image source 125; a memory 126 storing a code table 127; and an image processor 130.

In FIG. 1, electrical and/or data communication paths between components are depicted as solid lines, while light paths between components are depicted as stippled lines.

Light paths through system 100 are now described: light from light illumination system 101 are conveyed to relay optics 117, which conveys light from light illumination system 101 to modulator 118; image modulator 118 modulates the light into images (e.g. under control of image processor 130), which are then projected onto a screen (not depicted) using projection lens 120; light which is not used to form the images at modulator 118 is conveyed to light dump 119.

Light illumination system 101 is configured to produce a series of colours illuminating the at least one spatial light modulator, the series comprising: saturated colours; and, de-saturated colours which respectively replace one or more of the saturated colours on either side of a centre of the series of colours, as described in more detail below. For example, the saturated colours can include, but are not limited to, red, green and blue. The de-saturated colours can include, but are not limited to, white. Hence, light illumination system 101 comprises one or more light sources configured to produce the saturated colours and the de-saturated colours. Hence, light illumination system 101 can comprise one or more broadband light sources and/or one or more narrow band light sources, including, but not limited to laser light sources, light emitting materials, broadband sources, and the like. Furthermore, light illumination system 101 can comprise any suitable combination of spectral splitter optics, spectral combiner optics, pre-modulators and the like configured to produce and/or convey the series of colours to relay optics 117. Synchronization signals are relayed between image processor 130 and light illumination system 101 to align an illumination color series from light illuminator system 101 with image data and/or control signals transmitted by image processor 130 to image modulator 118.

Relay optics 117 is generally configured to convey the series of colours from light illumination system 101 to image modulator 118. In some implementations, relay optics 117 and light illumination system 101 can be combined in one module. Regardless, relay optics 117, and/or light conveying components of light illumination system 101 can include, but are not limited to, mirrors, dichroic mirrors, prisms, and the like.

Modulator 118 comprises one or more of a phase modulator, a light modulator, a reflective light modulator, a transmissive light modulator, a liquid crystal on silicon (LCOS) device, a liquid crystal display (LCD) device, and a digital micromirror device (DMD), and the like. Specifically, modulator 118 is configured to combine the series of colours from light illumination system 101 into images. In other words, image processor 130 is configured to control pixels of primary modulator 118 to switch between an on-state and an off-state depending on which colour is illuminating modulator 118 and what image is being formed. For example, on-state red, green and blue light received at primary modulator 118 are reflected, in sequence, and on a pixel-by-pixel basis, from primary modulator 118 to projection lens 120, which in turn directs the images towards one or more of a screen, a viewer and the like. Off-state light is directed towards light dump 119, which is configured to absorb the off-state light.

Image source 125 can include, but is not limited to, a memory storing digital copies of images for projection by system 100. Memory 126 can include, but is not limited to, one or more of a volatile memory and a non-volatile memory. In some implementations, image source 125 and memory 126 can be combined in one or more volatile memories and/or one or more non-volatile memories.

Image processor 130 can comprise one or more processors, image processors, central processing units and the like. Image processor 130 is in communication with image source 125 and memory 126, and modulator 118, and light illumination system 101. Image processor 130 is configured to: receive the digital copies of the images from image source 125; and control modulator 118 in accordance with digital copies of the images, as well as code table 127, as described in further detail below.

In general, system 100 is operated in a colour-sequence mode, which can also be referred to as a time-sequence mode, in which a series of colours from light illumination system 101 illuminate primary modulator 118: when a particular illuminating colour is illuminating modulator 118, other illuminating colours are not illuminating modulator 118. Hence, for example, red, green and blue images are conveyed to a viewer in series, and the viewer visually combines the images into a full-colour image. In other words, such systems rely on the temporal low-pass filter characteristic of human vision where rapidly changing intensity levels are perceived as the average intensity over time, and rapidly changing colour are perceived as an average colour over time.

Figure 2:
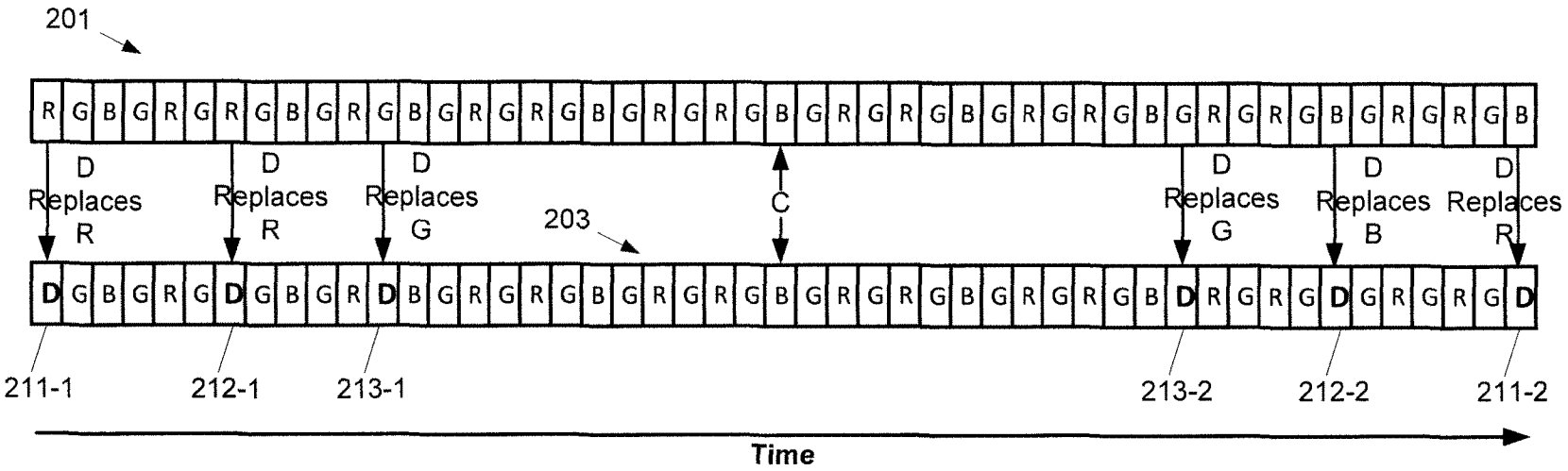
FIG. 2 depicts replacement of saturated colours with de-saturated colours in colours illuminating a modulator of the system of FIG. 1, according to non-limiting implementations.

Attention is next directed to FIG. 2, which depicts a series 201 of colours formed by light illumination system 101, which can illuminates modulator 118 prior to de-saturated colours replacing saturated colours in series 201. It is noted that throughout the present specification, including FIG. 2, the colours red, green and blue will be indicated by either, respectively "R", "G", "B", though other saturated colours are within the scope of present implementations. Hence, each rectangle in series 201 represents a time that red, green and blue light illuminates modulator 118, with the order of series 201 indicated the order of the rectangles, with the "time" arrow indicating that the left hand side of series 201 represents a first position of series 201, and the right hand side represents an end position of series 201. The relative duration of each colour in series 201 is also indicated by the width of each rectangle; while each colour in series 201 has an about equal duration, in other implementations colours can have different durations.

Hence, series 201 specifically comprises a series of red, green and blue light (i.e. saturated colours) which illuminate modulator 118 in the indicated series and/or order and/or sequence; it is appreciated that each colour can be formed into an image that is about a same size and/or shape of modulator 118 by one or more of light illumination system 101 and relay optics 117. It is further assumed in FIG. 2 that series 201 has duty cycles of 30% red, 50% green and 20% blue, though other duty cycles are within the scope of present implementations; indeed, the order colours in series 201, and the number of colours in series 201 can be selected in accordance with human vision models and the like.

FIG. 2 further depicts a series 203 of colours which is similar to series 201, however series 203 comprises: saturated colours (i.e. "R", "G" and "B"); and, de-saturated colours ("D") which respectively replace one or more of the saturated colours on either side of a centre C of series 203 of colours, as compared to series 201. In other words, series 203 is similar to series 201 with red and blue saturated colours being replaced with a de-saturated colour 211-1, 211-2 at either end of series 203 (i.e. with respect to series 201); while optional, as depicted in series 203, saturated colours in-between the first and last colours in series 203 are replaced with a de-saturated colour within series 203 (i.e. with respect to series 201); for example, de-saturated colours 212-1, 212-2 respectively replace red and blue saturated colours, with respect to series 201, and de-saturated colours 213-1, 213-2 each replace green saturated colours, with respect to series 201. It is further appreciated that more than the depicted saturated colours can be replaced with de-saturated colours, however de-saturated colours are generally "injected" (e.g. replace a saturated colour) into series 203 in pairs, one on either side of the centre C of series 203, for example pair 211-1, 211-2, pair 212-1, 212-2, and pair 213-1, 213-2.

Positions of the de-saturated colours in series 203 of colours can be selected based on a shape of an active sequence of pixels, as described in further detail below with respect to FIGS. 6 through 9.

Furthermore, the positions of the de-saturated colours in series 203 of colours can be symmetric or asymmetric. For example, positions of each de-saturated colour in each pair of de-saturated colours can be symmetrical with respect to the centre C, for example as with the two de-saturated colours 211-1, 211-3 at ends of series 203. However, in other implementations, locations of each de-saturated colour in each pair need not be symmetrical.

In any event, positions of the de-saturated colours can be at least at both a beginning and an end of series 203 of colours.

Furthermore, while three pairs of de-saturated colours are depicted, in other implementations series 203 can comprise only one pair, for example, pair 211-1, 211-2 located at ends of series 203; in yet further implementations, series 203 can comprise more than three pairs of de-saturated colours. Furthermore, other than at ends of series 203, de-saturated colours need not be provided in pairs (for example see graph 801-5, described below with respect to FIG. 9).

In any event, series 203 can illuminate modulator 118, and series 203 can be used to form images at modulator 118, by turning pixels of modulator 118 on and off when illuminated, in series, by colours of series 203. Furthermore, an order of colours in series 203 is generally fixed once the order is determined.

Specifically, image processor 130 can control each pixel in modulator 118 in synchronization with series 203 to produce images for viewing by a viewer. In general, each pixel in modulator 118 is controlled according to active sequences, which can generally comprise pixel on-states and pixel off-states that temporally correspond to a subset of series 203. In other words, each pixel in modulator 118 is controlled according to respective active sequences to reflect a subset of the colours of series 203 to projection optics and/or projection lens 120, the respective selected subset of the colours depending on pixel parameters including, but not limited to, pixel colour and pixel intensity.

Figure 3:
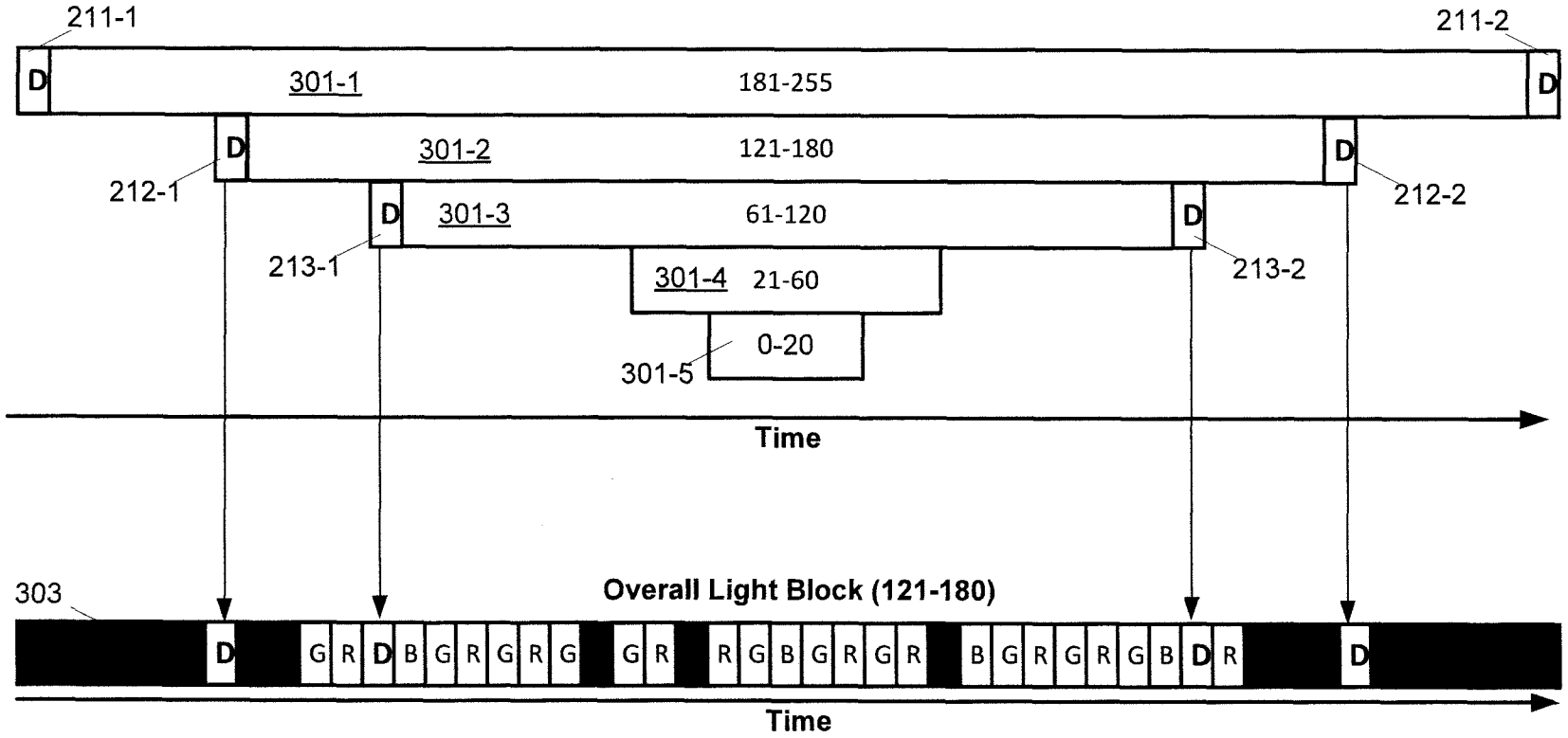
FIG. 3 depicts a relationship between active sequences and pixel on-states and off-states sequences at the modulator of the system of FIG. 1, according to non-limiting implementations.

Attention is next directed to FIG. 3, which schematically depicts active sequences 301-1, 301-2, 301-3, 301-4, 301-5 (interchangeably referred to hereafter, collectively, as active sequences 301 and, generically, as an active sequence 301). Each active sequence 301 represents a subset of series 203 which can be reflected from modulator 118 at each pixel in modulator 118, as part of an image being formed thereby under control of image processor 130 by turning a pixel to an on-state.

Further, in FIG. 3, while each saturated colour of series 203 is not indicated in each active sequence 301, a position of each de-saturated colour 211-1, 211-2, 212-1, 212-2, 213-1, 213-2 is indicated in each sequence 301; it is assumed that the saturated colours are located between each de-saturated colour 211-1, 211-2, 212-1, 212-2, 213-1, 213-2. Furthermore, while each active sequence 301 is depicted with respective pairs of de-saturated colours 211-1, 211-2, 212-1, 212-2, 213-1, 213-2 located respectively prior to (e.g. "leading") and following (e.g. "trailing") the first and last positions/saturated colours of each active sequence 301, when a given active sequence 301 includes a de-saturated colour between the first and last positions and/or saturated colours, such de-saturated colours are assumed to be available for activation within each active sequence; however, the de-saturated colours located within an active sequence need not be utilized (i.e. a corresponding pixel can be turned to an "off-state" when illuminated with such a de-saturated colour).

In depicted implementations, brightness level of pixels can be specified on a scale of 0-255, with "0" being a black pixel and "255" being at the brightest level available. Further, the active sequence used at a pixel can depend on the brightness level. For example, as depicted for brightness levels of 181-255 up to all saturated colours in series 203 can be used (e.g. saturated colours located between de-saturated colours 211-1, 211-2), depending on the brightness level and/or colour and/or pixel parameters of a corresponding pixel of an image being formed at modulator 118. Similarly, for brightness levels of 121-180, saturated colours located between de-saturated colours 212-1, 212-2 in series 203 can be used, depending on the brightness level and/or colour and/or pixel parameters of a corresponding pixel of an image being formed at modulator 118. Similarly, for brightness levels of 61-120, saturated colours located between de-saturated colours 213-1, 213-2 in series 203 can be used, depending on the brightness level and/or colour and/or pixel parameters of a corresponding pixel of an image being formed at modulator 118. It is apparent that each active sequence 301-1, 301-2, 301-3 is "bookended" by a corresponding pair of de-saturated colours. However, in other implementations, each active sequence 301 need not be bookended in such a manner. For example, neither of active sequences 301-4, 301-5, respectively corresponding to brightness levels of 21-60, and 0-20, are bookended by de-saturated colours, and each include a respectively decreasing portion of series 203.

FIG. 3 also includes an example sequence 303 to which a given pixel of modulator 118 can be controlled when the brightness level is at a level that is between 121 and 180. For example, example sequence 303 comprises a sequence of off-states (depicted in black) and on-states (depicted in white) to which the given pixel is controlled while being illuminated by series 203; further, sequence 303 further shows each colour that is being reflected by the given pixel for each on-state. In other words, while sequence 303 appears similar to series 203, series 203 represents a series of colour that is illuminating the given pixel, while sequence 303 represents the various off-states and on-states to which the given pixel is being controlled during the illumination.

As sequence 303 represents a sequence to which the given pixel is driven when the brightness level is between 121 and 180, only pixels that correspond to active sequence 301-2 are used, while pixels outside active sequence 301-2 (i.e. respectively before and after saturated colours 212-1, 212-2) are controlled to an off-state (i.e. they are shown as black in FIG. 3). Furthermore, the given pixel can be controlled to the off-state within active sequence 301-2 (i.e. between saturated colours 212-1, 212-2) depending on the brightness level and colour to which the given pixel is being controlled.

Such on-states and off-states can be specified in code table 127. In other words, the image data from image source 125 can specify pixel parameters and/or pixel brightnesses and/or pixel colours of pixels in an image, and code table 127 can relate each of the pixel parameters and/or pixel brightnesses and/or pixel colours to a sequence that a corresponding pixel in modulator 118 is to be controlled, given series 203.

As can further be seen in FIG. 3, sequence 303 further comprises the given pixel being in an on-state when illuminated with de-saturated colours 212-1, 212-2, 213-1, 213-2. Such an inclusion of de-saturated colours 212-1, 212-2, on a pixel-by-pixel basis before and after on-states of pixels in active sequence 301-2 can lead to a reduction in fringe artifacts. Inclusion of de-saturated colours 212-1, 212-2 can lead to a further reduction in fringe artifacts. Furthermore, as de-saturated colours 211-1, 211-2, 212-1, 212-2 in the image formed by modulator 118 represent a small proportion of the light, the de-saturated colours 211-1, 211-2, 212-1, 212-2 are generally not noticeable to a viewer, at least at video frame rates used in video (e.g. 30 Hz and higher).

Furthermore, while pixels that are controlled to an on-state at modulator 118 during active sequence 301-2 could be bookended by either of de-saturated colours 212-1, 212-2 and de-saturated colours 211-1, 211-1, respective locations of the de-saturated colours are selected to minimize respective times between at least one first de-saturated colour prior to a first saturated colour in active sequence 301-2 and between at least one second de-saturated colour following a last saturated colour in active sequence 301-2.

Put another way, as de-saturated colours 212-1, 212-2 are respectively closer to a beginning and an end of active sequence 301-2, than de-saturated colours 211-1, 211-1, de-saturated colours 212-1, 212-2 are selected to bookend active sequence 301-2 over—saturated colours 211-1, 211-1. Put yet another way de-saturated colours are injected both prior to and following an active sequence of the saturated colours in at least a portion of pixels within a video frame.

Summarizing concepts described heretofore, system 100 comprises: at least one spatial light modulator 118; a light illumination system 101 configured to produce a series 203 of colours illuminating at least one spatial light modulator 118, series 203 comprising: saturated colours; and, de-saturated colours which respectively replace one or more of the saturated colours on either side of a centre of the series of colours; and, an image processor 130 configured to control at least one spatial light modulator 118 to inject one or more of the de-saturated colours both prior to and following an active sequence of the saturated colours in at least a portion of pixels within a video frame, respective locations of the de-saturated colours selected to minimize respective times between at least one first de-saturated colour prior to a first saturated colour in the active sequence and between at least one second de-saturated colour following a last saturated colour in the active sequence.

Furthermore, image processor 130 can be further configured to control the at least one spatial light modulator 118 to inject one or more of the de-saturated colours between the first saturated colour and the last saturated colour in the active sequence in at least a portion of the pixels within the video frame.

Furthermore, an active sequence comprises black values prior to the first saturated colour and after the last saturated colour, other than the de-saturated colours, the first saturated colour comprising a first non-black colour in the active sequence, and the last saturated colour comprising a last non-black colour in the active sequence.

For example, series 203 of colours described herein defines an order and duration of monochrome saturated colours (and/or images) which illuminate modulator 118, which can be achieved by cycling the colour of light illuminating modulator 118. A typical sequence has a fixed order of illumination colours and/or images. For any given pixel on modulator 118, that pixel will be non-black during one or more of the colours in the series when the pixel colour to be displayed is not black, and black (i.e. in an off-state) otherwise. Sequences for which the pixel is not black will generally depend on the desired pixel colour and intensity to be displayed. Such pixel sequences can be defined with code table 127, which can include, but is not limited to, a lookup table, in which each pixel parameter and/or pixel colour and/or pixel intensity is related to one or more (as they may vary over time, e.g. for dithering) pixel values (e.g. on-state or off-state) for each colour in a series of illuminating colours.

As described above, one or more colours in the series can be replaces with de-saturated colours, including, but not limited to, white. The locations of the replaced and/or injected colours in a sequence of pixel states are chosen to balance the following goals:

A. Minimize a first time from a first injected de-saturated colour (prior to the first non-black colour pixel) to the first non-black pixel over code table 127; and B. Minimize a second time from a last non-black colour pixel to a last injected de-saturated colour (after the last non-black colour pixel) over code table 127.

In addition, a further goal can be to minimize a number of de-saturated colours injected into a sequence in order to, in turn, minimize saturated colour brightness loss.

For example, when all codes (i.e. sequences that pixels are controlled to on-states and off-states) use dispersed saturated colours such that the first and last active saturated colours are very close to ends of a sequence, as in sequence 303, a single injected de-saturated colour at either end of a sequence can suffice (i.e. in an altered sequence, similar to sequence 303, de-saturated colours 212-1, 212-3 are omitted). Indeed, it is appreciated that in sequence 303, pixel on-states are dispersed over time.

However, when light dispersion across time changes significantly with pixel colour or intensity then additional injected de-saturated colours can be used, as in sequence 303. These additional injected colours can be used to minimize time separation between first and last active (i.e. on-pixels) saturated colours and injected de-saturated colours.

Figure 4:
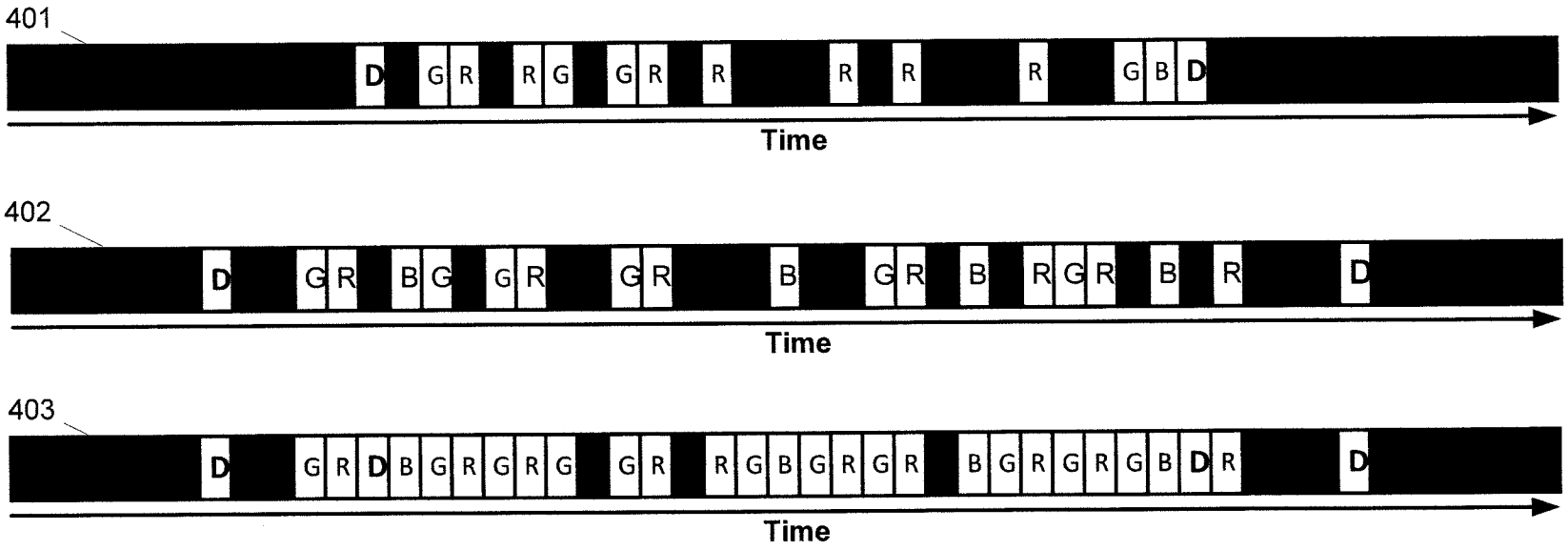
FIG. 4 depicts example sequences of on-states and off-states of a given pixel of the modulator of the system of FIG. 1, according to non-limiting implementations.

Attention is next directed to FIG. 4 which depicts three example sequences 401, 402, 403 of on-states and off-states of a given pixel at modulator 118, each of sequences 401, 402, 403 being similar to sequence 303. When a pixel colour or intensity results in a narrow dispersion of light, as in sequence 401, injected de-saturation colours can be used to "bookend" saturated colours with de-saturated colours. As the pixel colour or intensity results in more and more active saturated colours, for example as sequence 402, positions of injected colours in a sequence of on-states for a given pixel can be moved to outer injection de-saturated colours to "bookend" the active saturated colours. When the pixel colour or intensity is sufficiently high (e.g. above a threshold value), as in sequence 403 (similar to sequence 403) the "inner" de-saturated colours can be used in addition to the outer de-saturated colours to avoid reducing overall capability.

Figure 5:
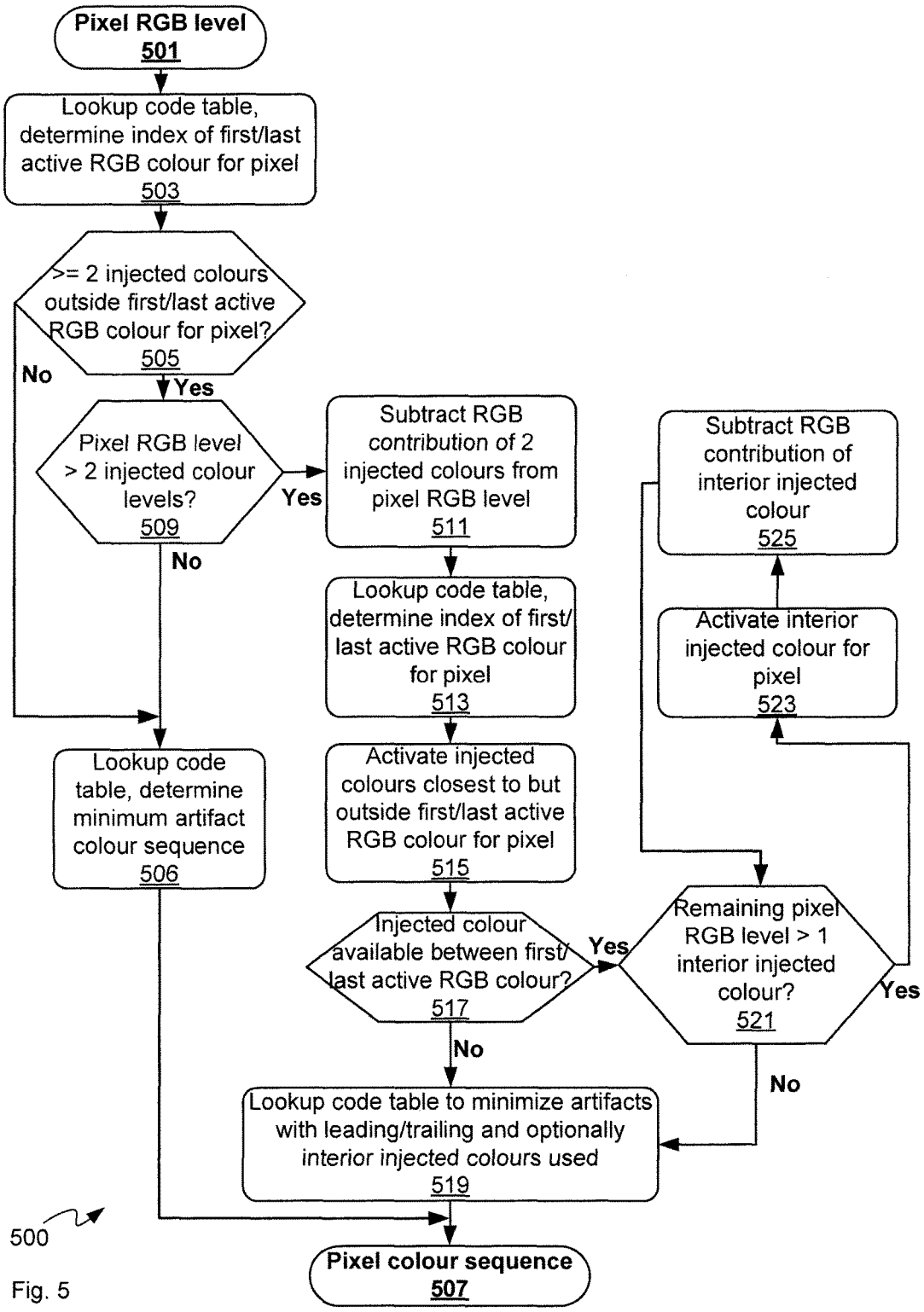
FIG. 5 depicts a method of injecting de-saturated colours into pixel sequences in a colour sequential image system, according to non-limiting implementations.

Attention is now directed to FIG. 5 which depicts a flowchart of a method 500 for injecting de-saturated colours into pixel sequences in a colour sequential image system, according to non-limiting implementations. In order to assist in the explanation of method 500, it will be assumed that method 500 is performed using system 100, and specifically by image processor 130. Indeed, method 500 is one way in which system 100 can be configured. Furthermore, the following discussion of method 500 will lead to a further understanding of system 100 and its various components. However, it is to be understood that system 100 and/or method 500 can be varied, and need not work exactly as discussed herein in conjunction with each other, and that such variations are within the scope of present implementations.

Regardless, it is to be emphasized, that method 500 need not be performed in the exact sequence as shown, unless otherwise indicated; and likewise various blocks may be performed in parallel rather than in sequence; hence the elements of method 500 are referred to herein as "blocks" rather than "steps". It is also to be understood, however, that method 500 can be implemented on variations of system 100 as well.

Furthermore, method 500 will be described with reference to "RGB" levels which can include brightness values for red, green and blue pixel in images, for example images stored at image source 125 and processed by image processor 130. However, other implementations can include levels, and/or brightness levels of other saturated colours.

At block 501, image processor 130 receives an RGB level for a given pixel in an image, for example as a set of RGB levels in one or more sets of image data received from image source 125. At block 503, image processor 130 processes code table 127 stored in memory 126 to determine an index of a first and last active saturated colour (e.g. RGB colour) for the given pixel. At block 505, image processor 130 determines whether there are two or more injected de-saturated colours (i.e. "injected colours") outside the first and last active saturated/RGB colour for the given pixel. When not (i.e. a "No" decision at block 505), at block 506, image processor 130 processes code table 127 to determine a colour sequence to use for the given pixel, for example a colour sequence that leads to minimum artifacts for the image in which the given pixel is a subset, and at block 507 the given pixel is driven at modulator 118 according to the colour sequence determined at block 506. Blocks 503 and 506 can occur in parallel with each other: for example, image processor 130 processes code table 127 in both of blocks 503, 506, however image processor 130 can alternatively process code table 127 one in the implementation of blocks 503, 506.

Returning to block 505, when image processor 130 determines that there are two or more injected de-saturated colours outside the first and last active saturated/RGB colour for the given pixel (i.e. a "Yes" decision at block 505), at block 509, image processor 130 determines whether a pixel RGB (e.g. brightness) level is greater than a brightness level for twice a level of an injected de-saturated colour. In other words, image processor 130 determines whether the given pixel will have an adequate brightness level (e.g. greater than zero) if two de-saturated colours are injected into a sequence. For example, in some implementations, as described above with respect to series 201, 203, saturated colours in a series of colours are replaced with de-saturated colours; in some of these implementations code table 127 can include sequences for pixels that assume that the replaced saturated colours are to be used by a pixel at modulator 118; hence, block 509 is implemented in order to determine whether there is enough brightness available on the remaining saturated colours in a sequence to be reflected by the given pixel. Put another way, image processor 130 can be further configured to inject one or more of the de-saturated colours at a given pixel when a brightness level of the given pixel is greater than twice a respective brightness level of the de-saturated colours.

In any event, when a "No" decision occurs at block 509, blocks 509 and 507 are implemented as described above.

However, when a pixel RGB level is determined to be greater than a brightness level for twice a level of an injected de-saturated colour (i.e. a "Yes" decision at block 509), blocks 511, 513, 515 and optionally block 517 occur. Specifically, at block 511, image processor 130 subtracts the RGB brightness level contribution of the two injected de-saturated colours from the pixel RGB level (block 511). At block 513, image processor 130 processes code table 127 to determine an index of a first and last active saturated/RGB colour for the given pixel, for example positions in a first and last active saturated/RGB colour series of colours similar to series 203. At block 515, image processor 130 activates the injected de-saturated colours closest to, but outside the first and last active saturated/RGB colour of a sequence of saturated colours to which the given pixel is to be driven.

At optional block 517, image processor 130 determines whether there are any injected de-saturated colours available between the first and last active saturated/RGB colours. When not (i.e. a "No" decision at block 517), or when block 517 is not executed (as block 517 is optional), block 519 occurs in which image processor 130 processes code table 127 to determine a colour sequence to use for the given pixel, for example a colour sequence that leads to minimum artifacts for the image in which the given pixel is a subset, the colour sequence including leading and trailing de-saturated colours; and at block 507 the given pixel is driven at modulator 118 according to the colour sequence determined at block 519. Put another way, memory 126 stores code table 127 that relates one or more of pixel parameters, pixel colour and pixel intensity to pixel values, the pixel values defining at least an active sequence, and image processor 130 is configured to control the at least one spatial light modulator 118 by processing code table 127 and image data representative of images to be formed by the at least one spatial light modulator 118.

However, when image processor 130 determines that there are injected de-saturated colours available between the first and last active saturated/RGB colours (i.e. a "Yes" decision at block 517), at block 521 image processor 130 determines whether there is any remaining pixel RGB brightness/level available to shift to interior injected de-saturated colours (i.e. image processor 130 determines whether remaining pixel saturated colour/RGB level is greater than a level for one interior injected colour). When not, (i.e. a "No" decision at block 517), blocks 519 and 507 are implemented. However, when image processor 130 determines that a remaining pixel saturated colour/RGB level is greater than a level for one interior injected colour (i.e. a "Yes" decision at block 521), blocks 523, 525 are implemented. Specifically, at block 523 image processor 130 activates one interior injected de-saturated colour (i.e. a de-saturated colour between a first and last saturated colour in a sequence), and at block 525, image processor 130 subtracts the RGB contribution of the interior injected de-saturated colour from the level of the saturated/RGB colours. Blocks 521 to 525 repeat when there are further interior de-saturated colours available and when there is brightness available. However, in some implementations, not all interior de-saturated colours need to be activated even when brightness available. For example, a maximum number of interior de-saturated colours can be used, including, but not limited to, two interior de-saturated colours. However, other algorithms for determining a maximum number of interior de-saturated colours are within the scope of present implementations that take into account the tradeoff between brightness loss that can occur using the de-saturated colours and reduction of fringe effects.

In any event, when a "No" decision occurs at block 521, after one or more occurrences of blocks 523, 525, blocks 519, 507 occurs, however with the optional interior de-saturated colours injected into the sequence.

It is appreciated that method 500 can be repeated and/or performed in parallel for each pixel in each image to be formed at modulator 118. Furthermore, as method 500 is generally used to reduce fringe artifacts in objects that are moving in a series of images (i.e. objects moving a video stream of images), image processor 130 can optionally process the images to determine whether there are one or more objects moving and, when so, implement method 500, and, when not, method 500 can be skipped, with image processor 130 configured to control modulator 118 without injecting de-saturated colours into the image. Alternatively, method 500 can be implemented when image processor 130 determines that one or more objects are moving in the images above a threshold rate of change of position.

In yet further implementations, method 500 can be implemented only on given pixels in the images that correspond to the one or more moving objects.

In other words, image processor 130 can switch between a mode where de-saturated colours are injected into the images on a pixel-by-pixel basis and a mode where de-saturated colours are not injected into the images, the mode switching depending on the content of the images.

Figure 6:
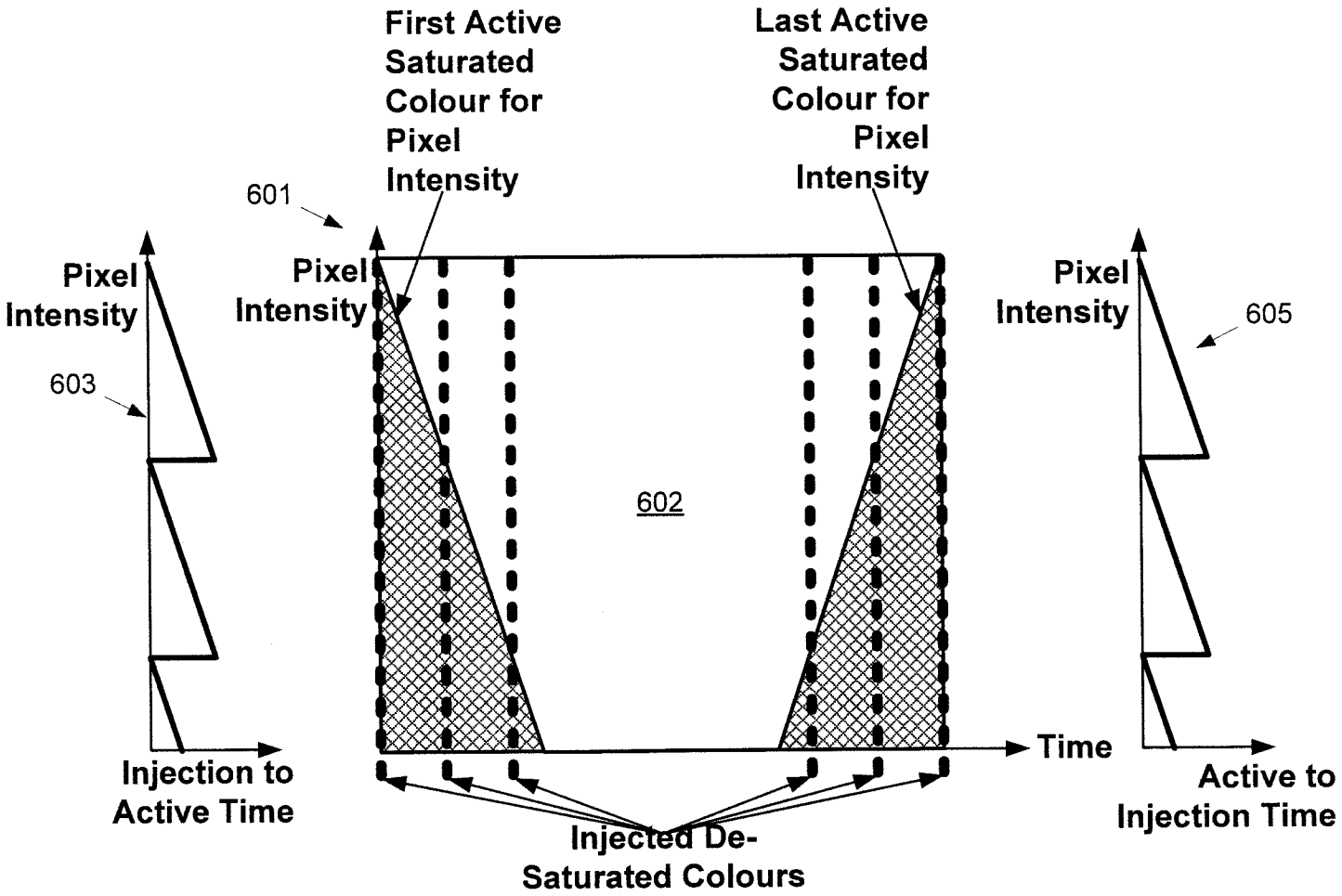
FIG. 6 depicts a graph of first and last active saturated colours in active sequences with respect to pixel intensity, as well as associated times between leading and trailing de-saturated colours and outer active saturated colours of the active sequences, according to non-limiting implementations.

Attention is next directed to FIG. 6, which depicts a graph 601 of first and last active saturated colours in active sequences 602 with respect to pixel intensity. The full width of graph 601 represents a series of colours that illuminate modulator 118, with shaded areas of graph 601 representing colours that are not used by a pixel. Hence, as pixel intensity increases, more of the series of colours are used. Graph 601 also depicts non-limiting example locations of de-saturated colours injected into the series, as represented by the vertical broken lines. While six de-saturated colours are represented, in other implementations, as few as two de-saturated colours can be present, for example, one at either end of the series of colours. It is further noted that a shape of active sequences 602 with respect to pixel intensity is both symmetrical and has linear sides, indicating that active sequences 602 generally increase linearly in size as pixel intensity increases.

Also depicted is a graph 603 of of pixel intensity vs. a time between an injected de-saturated colour and a first active saturated colour (using the closest injected de-saturated colour that precedes a given first active saturated colour at a given pixel intensity), and a similar graph 605 of pixel intensity vs. a time between a last active saturated colour a closest injected de-saturated colour that follows the last active saturated colour at a given pixel intensity. As is apparent, each of graphs 603, 605 is a sawtooth shape, with time dropping to a minimum at each intersection between de-saturated colours and the lines defining active sequences 602. In other words, as pixel intensity increases, and a corresponding active sequence 602 becomes wider than the inner de-saturated colours, the next two outer de-saturated colours are used to bookend the active sequences 602.

A position of each de-saturated colour with respect to active sequences 602 can be selected in manner that replaces as few saturated colours as possible with injected de-saturated colours, and also minimizes a time from the active saturated colours to surrounding injected de-saturated colours, as shown in graphs 603, 605. Minimizing a number of injected de-saturated colours maximizes saturated colour brightness while minimizing a time from first and last active saturated colours to surrounding de-saturated colours maximizes an improvement in colour fringe artifacts.

For example, attention is next directed to FIG. 7 which compares graph 601 to a similar graph 701 that has ten injected de-saturated colours five de-saturated colours on either side of a centre of the active sequences), as compared to six injected de-saturated colours in graph 601. Graphs 601, 701 are otherwise similar. FIG. 7 also shows graph 603, adjacent graph 601, and reproduced, in stippled lines, at a graph 703 which is similar to graph 603 but for the ten injected de-saturated colours of graph 701.

The exact location and number of injected de-saturated colours can be selected to achieve a tradeoff between saturated colour brightness and artifact reduction for a sequence used. As shown in FIG. 7, placement of positions of de-saturated colours varies with the way different sequences change in active sequence time with pixel intensity. In other words, the configuration of graph 701 can lead to a better reduction in fringe effects as compared to the configuration of graph 601, however, the configuration of graph 701 leads to overall lower saturated color brightness capability.

Attention is next directed to FIGS. 8 and 9 which depicts graphs 801-1, 801-2, 801-3, 801-3, 801-5 (collectively referred to as graphs 801), and graphs 803-1, 803-2, 803-3, 803-3, 803-5 (collectively referred to as graphs 803). Each of graphs 801 are similar to graph 601, but show non-limiting example shapes of active sequences, with respective associated graphs 803 showing times between a de-saturated colour and a first active saturated colour, similar to graph 603.

In particular, it is noted that none of the active sequences shown in graphs 801 have a linear shape, and that de-saturated colours are injected at both a beginning and end of a series of colours, and optionally also at, adjacent to, before and/or after abrupt changes in slope of the active sequences. In other words, positions of the de-saturated colours can be selected based on a shape of an active sequence.

Furthermore, positions of the de-saturated colours in the series of colours are one of symmetric and asymmetric with respect to one or more of the series of colours and the active sequence For example, in each of graphs 801-1 to 801-4, de-saturated colours are generally injected symmetrically. However, with reference to graph 801-5, the depicted active sequence is asymmetric, and further de-saturated colours are also injected asymmetrically (with graph 803-5 depicting the time differences between leading and trailing de-saturated colours (i.e. respectively prior to and following active sequences) similar to graphs 603 and 605, respectively). As in graphs 801-1 to 801-4, in graph 801-5 de-saturated colours are injected at and/or adjacent to abrupt changes in slope of the active sequence. Further while in symmetric active sequences depicted herein, de-saturated colours are injected symmetrically, and while in asymmetric active sequences depicted herein, de-saturated colours are injected asymmetrically, in other implementations, de-saturated colours can be injected asymmetrically into symmetric active sequences and de-saturated colours can be injected symmetrically into asymmetric active sequences.

In any event, disclosed herein are systems in which de-saturated colours are injected into saturated colour sequences at a colour sequential image system to reduce fringe artifacts.

Those skilled in the art will appreciate that in some implementations, the functionality of system 100 can be implemented using pre-programmed hardware or firmware elements (e.g., application specific integrated circuits (ASICs), electrically erasable programmable read-only memories (EEPROMs), etc.), or other related components. In other implementations, the functionality of system 100 can be achieved using a computing apparatus that has access to a code memory (not shown) which stores computer-readable program code for operation of the computing apparatus. The computer-readable program code could be stored on a computer readable storage medium which is fixed, tangible and readable directly by these components, (e.g., removable diskette, CD-ROM, ROM, fixed disk, USB drive). Furthermore, it is appreciated that the computer-readable program can be stored as a computer program product comprising a computer usable medium. Further, a persistent storage device can comprise the computer readable program code. It is yet further appreciated that the computer-readable program code and/or computer usable medium can comprise a non-transitory computer-readable program code and/or non-transitory computer usable medium. Alternatively, the computer-readable program code could be stored remotely but transmittable to these components via a modem or other interface device connected to a network (including, without limitation, the Internet) over a transmission medium. The transmission medium can be either a non-mobile medium (e.g., optical and/or digital and/or analog communications lines) or a mobile medium (e.g., microwave, infrared, free-space optical or other transmission schemes) or a combination thereof.

Persons skilled in the art will appreciate that there are yet more alternative implementations and modifications possible, and that the above examples are only illustrations of one or more implementations. The scope, therefore, is only to be limited by the claims appended hereto.

What is claimed is:

1. A system comprising:

at least one spatial light modulator;

a light illumination system configured to produce a series of colours illuminating the at least one spatial light modulator, the series comprising: saturated colours; and, pairs of de-saturated colours which respectively replace respective saturated colours on either side of a centre of the series of colours; and, an image processor configured to, in at least a portion of pixels within a video frame:

control the at least one spatial light modulator to inject one or more of the de-saturated colours both prior to and following an active sequence of the saturated colours, the active sequence comprising a subset of the series of colours used at the at least one spatial light modulator at each pixel in the at least one spatial light modulator, as part of an image being formed thereby under control of the image processor, by turning the pixel to an on-state and to an off-state within the active sequence depending on a brightness level and colour to which the pixel is being controlled, respective locations of the de-saturated colours selected to minimize respective times between at least one first de-saturated colour prior to a first non-black colour in the active sequence and between at least one second de-saturated colour following a last non-black colour in the active sequence, the pixel outside the active sequence, before and after the de-saturated colours, being controlled to the off-state.

2. The system of claim 1, wherein the image processor is further configured to control the at least one spatial light modulator to inject one or more of the de-saturated colours between the first non-black colour and the last non-black colour in the active sequence in at least a portion of the pixels within the video frame.

3. The system of claim 1, wherein the image processor is further configured to inject one or more of the de-saturated colours at a given pixel when a brightness level of the given pixel is greater than twice a respective brightness level of the de-saturated colours.

4. The system of claim 1, further comprising a memory storing a code table that relates one or more of pixel parameters, pixel colour and pixel intensity to pixel values, the pixel values defining at least the active sequence, and the image processor is further configured to control the at least one spatial light modulator by processing the code table and image data representative of images to be formed by the at least one spatial light modulator.

5. The system of claim 1, wherein positions of the de-saturated colours in the series of colours are selected based on a shape of the active sequence.

6. The system of claim 1, wherein positions of the de-saturated colours in the series of colours are one of symmetric and not-symmetric with respect to one or more of the series of colours and the active sequence.

7. The system of claim 1, wherein positions of the de-saturated colours are at least at both a beginning and an end of the series of colours.

8. A method comprising:

in a system comprising: at least one spatial light modulator; a light illumination system configured to produce a series of a plurality of colours illuminating the at least one spatial light modulator, the series comprising: saturated colours; and, pairs of de-saturated colours which respectively replace respective saturated colours on either side of a centre of the series of colours; and, an image processor, in at least a portion of pixels within a video frame, controlling the at least one spatial light modulator to inject one or more of the de-saturated colours both prior to and following an active sequence of the saturated colours, the active sequence comprising a subset of the series of colours used at the at least one spatial light modulator at each pixel in the at least one spatial light modulator, as part of an image being formed thereby under control of the image processor, by turning the pixel to an on-state and to an off-state within the active sequence depending on a brightness level and colour to which the pixel is being controlled, respective locations of the de-saturated colours selected to minimize respective times between at least one first de-saturated colour prior to a first non-black colour in the active sequence and between at least one second de-saturated colour following a last non-black colour in the active sequence, the pixel outside the active sequence, before and after the de-saturated colours, being controlled to the off-state colours. colours.

9. The method of claim 8, further comprising controlling the at least one spatial light modulator to inject one or more of the de-saturated colours between the first non-black colour and the last non-black colour in the active sequence in at least a portion of the pixels within the video frame.

10. The method of claim 8, further comprising injecting one or more of the de-saturated colours at a given pixel when a brightness level of the given pixel is greater than twice a respective brightness level of the de-saturated colours.

11. The method of claim 8, further comprising controlling the at least one spatial light modulator by processing a code table and image data representative of images to be formed by the at least one spatial light modulator, the code table stored at a memory, the code table relating one or more of pixel parameters, pixel colour and pixel intensity to pixel values, the pixel values defining at least the active sequence.

12. The method of claim 8, wherein positions of the de-saturated colours in the series of colours are selected based on a shape of the active sequence.

13. The method of claim 8, wherein positions of the de-saturated colours in the series of colours are one of symmetric and not-symmetric with respect to one or more of the series of colours and the active sequence.

14. The method of claim 8, wherein positions of the de-saturated colours are at least at both a beginning and an end of the series of colours.

15. The system of claim 1, the first de-saturated colour and the second de-saturated colour used by the spatial light modulator to form de-saturated monochrome colour images injected before and after saturated colour images of the video frame, the active sequence used by the spatial light modulator to form the saturated colour images, wherein the image processor is further configured to: determine whether the saturated colour images include one or more moving objects; when the saturated colour images include the one or more moving objects, inject the de-saturated monochrome colour images before and after the saturated colour images; and when the saturated colour images do not include the one or more moving objects, skipping injecting the de-saturated monochrome colour images before and after the saturated colour images.

16. The method of claim 8, the first de-saturated colour and the second de-saturated colour used by the spatial light modulator to form de-saturated monochrome colour images injected before and after saturated colour images of the video frame, the active sequence used by the spatial light modulator to form the saturated colour images, the method further comprising: determining whether the saturated colour images include one or more moving objects; when the saturated colour images include the one or more moving objects, injecting the de-saturated monochrome colour images before and after the saturated colour images; and when the saturated colour images do not include the one or more moving objects, skipping injecting the de-saturated monochrome colour images before and after the saturated colour images.

* * * * *